United States Patent [19]

Moreau

[11] Patent Number: 4,912,373

[45] Date of Patent: Mar. 27, 1990

[54] IGNITION CONTROL CIRCUIT

[75] Inventor: Jean-Michel Moreau, Grenoble; France

[73] Assignee: SGS-Thomson Microelectronics S.A., Gentilly, France

[21] Appl. No.: 231,061

[22] Filed: Aug. 11, 1988

[30] Foreign Application Priority Data

Aug. 27, 1987 [FR] France ..... 87 12103

[51] Int. Cl.[4] ..... H05B 37/00

[52] U.S. Cl. ..... 315/209 R; 315/209 T; 123/644

[58] Field of Search ..... 315/209 T, 209 R, 200 R; 307/300, 303, 443; 123/644

[56] References Cited

U.S. PATENT DOCUMENTS

| | | | |
|---|---|---|---|
| 3,838,672 | 10/1974 | Richards et al. | 123/644 |
| 4,246,881 | 1/1981 | Bodig | 123/644 |
| 4,248,200 | 2/1981 | Sugiura et al. | 123/644 |
| 4,574,221 | 3/1986 | Hess et al. | 315/209 R X |

FOREIGN PATENT DOCUMENTS

| | | |
|---|---|---|
| 2427713 | 6/1979 | European Pat. Off. . |
| 2024941 | 7/1979 | United Kingdom . |

*Primary Examiner*—David Mis

*Attorney, Agent, or Firm*—Lowe, Price, LeBlanc, Becker & Shur

[57] ABSTRACT

A bipolar power switch (4) in series with the primary of an ignition coil (2) and a detection resistor (R1) associated with a voltage divider (R2, R3) supplying a voltage $V_D$; a controlled amplifier-comparator (9), the first input of which receives the measured voltage and the second input receives a reference voltage (8), and the output of which is connected with the base of the switch (4), this amplifier-comparator acting for limiting the base current when the measured voltage is approaching the reference voltage; a series resistor (R10) between the output of the amplifier-comparator (9) and the base of the switch (4); and a differential amplifier (11), the inputs of which are connected with the terminals of the series resistor and the output of which is connected with the first input of the amplifier-comparator.

5 Claims, 2 Drawing Sheets

Fig. 1
PRIOR ART
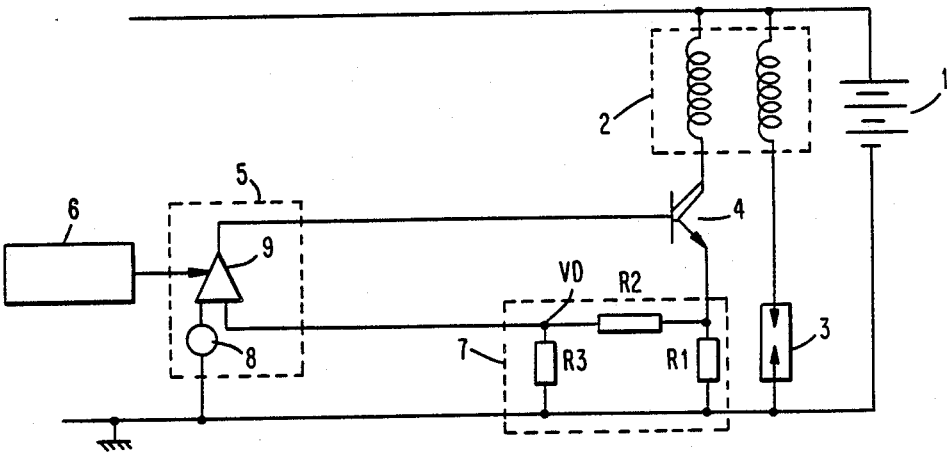
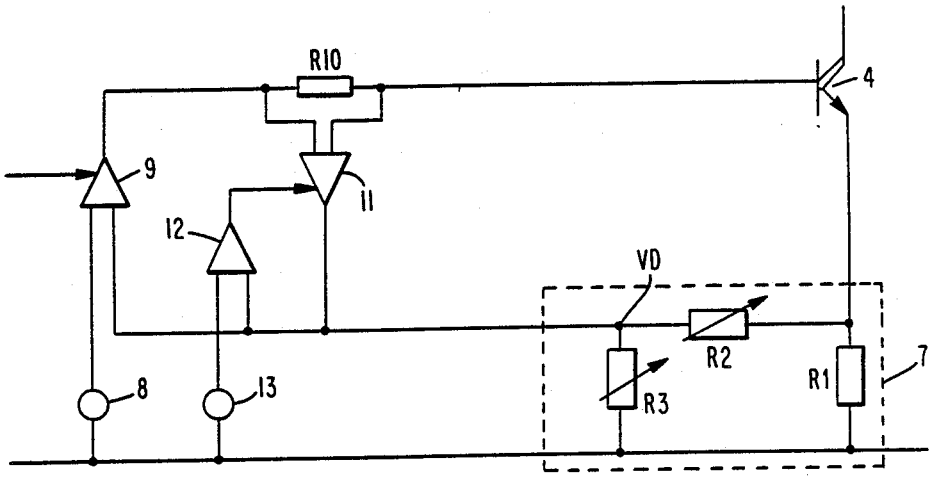
Fig. 2

IGNITION CONTROL CIRCUIT

BACKGROUND OF THE INVENTION

The instant invention relates to an ignition control circuit and more particularly to a so-called electronic control circuit for automobile vehicles in which the spark of the ignition plug is obtained at the secondary of a voltage ignition coil when abruptly interrupting the current flowing through the primary of this coil.

Since a few years, it has been possible to use as a switch an electronic switch. FIG. 1 shows an embodiment of such a conventional electronic ignition system comprising an energy storage battery 1 (the vehicle battery) and an ignition coil 2, the secondary of which is connected with an ignition plug 3 and the primary of which is in series with an electronic switch 4, such as a Darlington circuit, allowing the current to flow or interrupting the current in the coil. A control device 5 permits to control, in relation with the information received from the engine 6, the switching on, then the switching off, of switch 4, this control device acts on the gate of the main switch which, in the given example, is of the bipolar-type. Therefore, when switch 4 is on, the current starts flowing through the primary of the coil and progressively increases. When switch 4 is off, a spark is produced in the ignition plugs 3.

In order to obtain a good operation of this device, at the opening of the power switch 4, the current attained in the primary of coil 2 has to be sufficient for causing the spark at the secondary. Ideally, the duration of the switching on of the power switch 4 should be provided so that this current value be precisely attained. In fact, since the engines operate at a variable speed, it is difficult to very precisely determine this duration and it is usually necessary to switch on the power switch 4 for a longer time duration than it is necessary. If no steps were taken, this would result in the flowing of a too important current through the primary of coil 2 and power switch 4.

In order to avoid those excess currents, current limitation means, an embodiment of which is shown in FIG. 1, are conventionally provided for.

Thus, a detection circuit 7 is serially connected with the power switch 4. This detection circuit comprises a resistor R1 having a low value in parallel with a dividing circuit comprising resistors R2 and R3, the voltage measured at the junction between resistors R2 and R3 being proportional to the current flowing through resistor R1. This measured voltage $V_D$ is compared with a reference voltage 8 in a controlled comparator-amplifier 9, the output of which supplies a base current to the power switch 4. Thus, at the switching on of power switch 4, when the current is low in resistor R1, the base current is maximum, and when the measured voltage is approaching the reference voltage 8, corresponding to the limit current, the base current is lowered. During this phase when the base current of the power switch 4 is lowered, the power switch no longer acts as a simple switch but as a current linear amplifier.

In this system, the whole set of components 4, 7, 8 and 9 forms a servo-control loop. In practice, this loop may prove to be unstable. The amplifier 9, implemented in an integrated circuit, is a high gain-amplifier, for example a three-stage amplifier. Owing to the present technologies, this gain may vary for each stage by a factor 3, for example between 100 and 200. Similarly, the gain of power switch 4, which is for example a multiple-stage Darlington circuit, may substantially vary, for example by a factor 30. Under those conditions, it is very difficult in practice to ensure a predetermined value to the gain of the servo-control loop and therefore the stability of the servo-control of the current.

Therefore, in practical systems, it is compulsory to strictly select the Darlington circuits, which restricts the choice of the suppliers and therefore increases the costs, and it is also necessary to use in the servo-control loop an external stabilization capacitor, which increases the number of terminals to be provided in the integrated circuit and also induces an increase in costs.

SUMMARY OF THE INVENTION

An object of the instant invention is to provide for an ignition control circuit, the servo-control of which in the current limitation phase is stable owing to a foreseeable loop gain.

Another object of the instant invention is to provide that this control circuit, which is in practice constituted by a specific integrated circuit, may be used with different transistors or bipolar Darlington-circuits.

More particularly, an object of the invention is to render reproducible the contribution in the loop gain of the amplifier included in the control device when the latter is carried out in the form of an integrated circuit.

Another object of the instant invention is to render this contribution adjustable from outside in order to compensate for the gain differences produced by the various types of power devices.

In order to attain those objects and others, the instant invention provides for a circuit comprising a bipolar power switch in series with the primary of an ignition coil and a detection resistor; a voltage divider in parallel on the detection resistor providing a measured voltage proportional to the current in the resistor; a controlled amplifier-comparator, the first input of which receives the measured voltage and the second input receives a reference voltage, the output of which is connected with the base of the power switch and a control input of which can receive an inhibition order signal, this amplifier-comparator acting for limiting the base current when the measured voltage is approaching the reference voltage; a series resistor between the output of the amplifier-comparator and the base of the power switch; and a differential amplifier, the inputs of which are connected with the terminals of the series resistor, and an output of which is connected with the first input of the amplifier-comparator.

Preferentially, this circuit further comprises means for inhibiting the action of the differential amplifier when the measured voltage is lower than a threshold voltage chosen, at the utmost, equal to the reference voltage.

Preferentially, the differential amplifier comprises multi-collector transistors, the emitters of which are connected with the terminals of the series resistor, the first collectors of which are interconnected and the second collectors of which are connected to active charges constituted by transistors operating as a current mirror.

Preferentially, the resistors of the voltage divider are adjustable so that their ratio is set for obtaining a current limitation in the power switch at a predetermined value and the absolute value of the resistor in series with the input of the amplifier-comparator is chosen for determining the gain of the servo-control loop.

BRIEF DESCRIPTION OF THE DRAWINGS

Other advantages and features of the instant invention will clearly appear from the following detailed description of preferred embodiments, in connection with the attached drawings, wherein:

FIG. 1 is a diagram partially drawn in the form of blocks illustrating an ignition control circuit according to the prior art;

FIG. 2 is a diagram partially drawn in the form of blocks illustrating the instant invention.

DETAILED DESCRIPTION OF THE INVENTION

Figure 3:
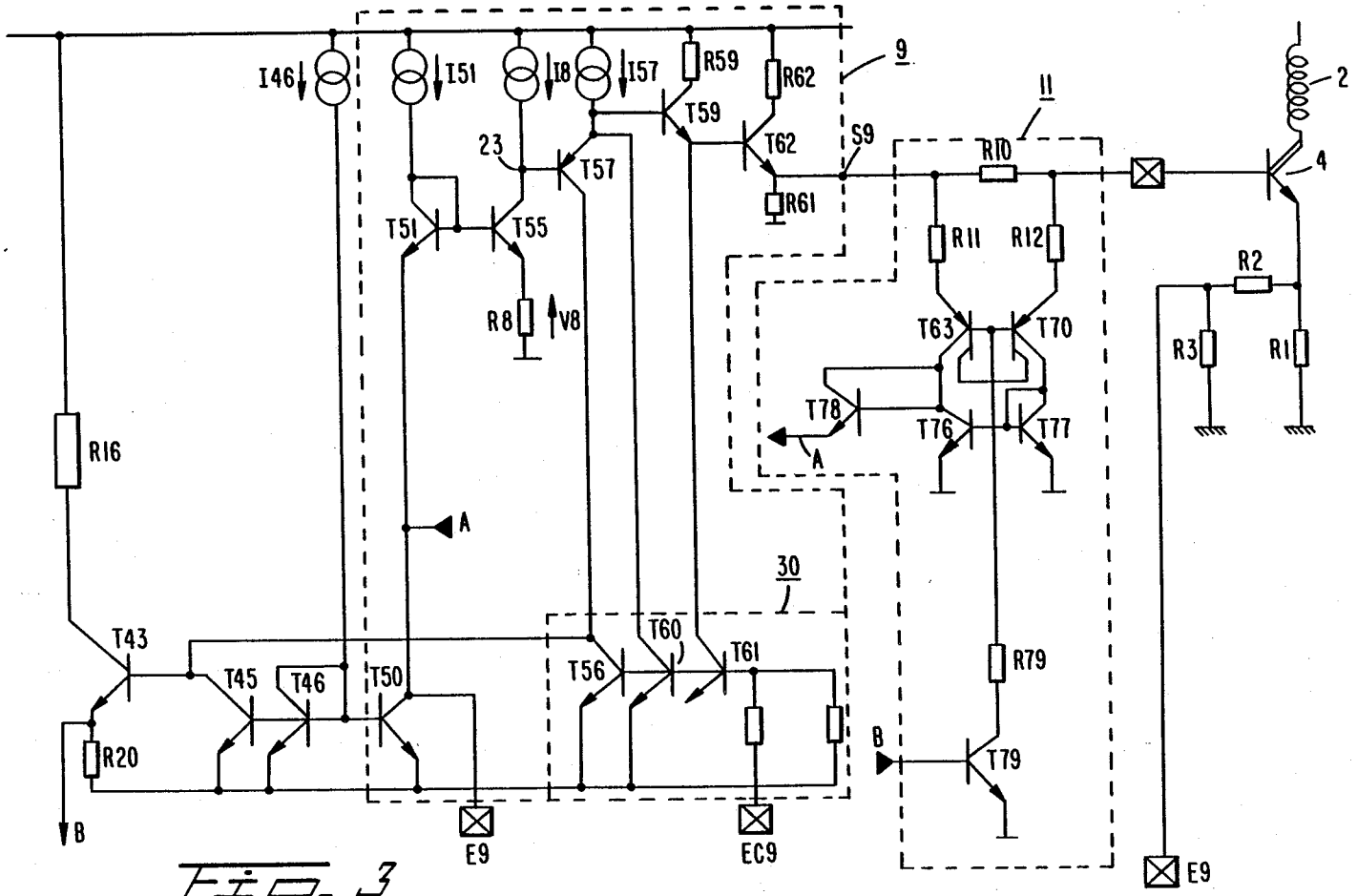
FIG. 3 shows in detail portions of the circuit according to the instant invention.

In the schematic diagram of FIG. 2, some like elements as in FIG. 1, labelled with the same references, are shown again, that is, the power switch 4, the detector 7, the reference voltage source 8 and the controlled amplifier-comparator 9. This high gain amplifier-comparator 9 receives, as shown in FIG. 1, on its second input a voltage reference 8 and on its first input a voltage $V_D$ proportional to the current in resistor R1, the proportion coefficient being set by the ratio of the values of resistors R2 and R3.

The output of this amplifier 9 acts upon the control terminal of the power switch 4 through a resistor R10. This resistor R10 constitutes a measurement means for the input current in the control terminal, usually the base, of the bipolar power switch 4.

Moreover, a differential amplifier 11 with a transconductance $Y_D$ (the ratio between the output current variation and the input voltage variation) has its inputs connected with the terminals of resistor R10. The output of this differential amplifier 11 is connected with the first input of the amplifier-comparator 9 in such a direction that the loop formed by this amplifier-comparator, the resistor R10 and the differential amplifier 11 causes a negative feedback.

In the absence of a feedback loop caused by the differential amplifier 11, the voltage on resistor R1 is first divided in the ratio of resistors R3/R2+R3 then is amplified by the amplifier-comparator 9 with a total voltage gain equal to:

$$[R3/(R2+R3)].\ G(9),$$

wherein G(9) is the gain of the amplifier-comparator 9 (a high gain, little reproducible). But, on the other hand, when the differential amplifier 11 introduces a negative feedback, and if G(9) is high, the total gain is such that the error signal between the inputs of the amplifier-comparator A remains always low; this involves that any current variation coming from the junction between resistors R2 and R3 is absorbed by amplifier 11. The slope or transconductance is then calculated between the input of resistor R1 and the control terminal of the power switch 4:

$$dI/dV = 1/R2.R10 \cdot y_D.$$

Accordingly, this structure provides the following advantages:

In spite of all the variations which may affect the gain of the high-gain amplifier-comparator 9, the transconductance between the detection resistor R1 and the control terminal can be maintained at a well-determined value, assuming the R2, R10 and $Y_D$ are determined. In fact, it is known that, whereas the voltage gain of an integrated amplifier is subject to large variations, which was the case with the amplifier 9 as previously used, the transconductance of a differential amplifier is a reproducible information. Thus, only the current gain of the power switch 4 may be a scattering factor in the total gain of the servo-control loop of the current and the stability is more easily controllable.

Moreover, since the gain of this loop depends upon the value of resistor R2, it will be possible by choosing an adjustable resistor to modify this value for adapting the same control integrated circuit to various power devices. During the manufacturing phase, it will therefore be possible to use a batch of power devices, the gain of which would be particularly high and would be compensated by an increase of resistor R2, which will be implemented in the form of a discrete resistor external to the control integrated circuit.

The oscillations which occurred in the conventional systems are eliminated. Indeed, the ignition coil with its parasitic capacitances constitutes an oscillating circuit which is driven for example when the power switch 4 switches from the on state (when the maximal base current is supplied) to the current regulation state (when one starts to decrease, rather abruptly, the base current of the power switch), that is, when the voltage through the coil abruptly changes from LdI/dt to a null value (I constant). The large voltage variation at that time triggers damped oscillations which may impair the other devices connected to the circuit. In order to dampen those oscillations at best, it is essential that the impedance at the collector of the power switch remains low. To achieve this purpose, the gain of the servo-control loop which tends to transform it into a high impedance source must not be too high. According to the invention, this gain can be controlled by setting the value of resistor R2.

Thus, the setting of potentiometer R2, R3 has a dual function:

by setting R2, the gain of the servo-control loop is determined, by setting the ratio R2/R3, the desired level of current limitation is determined in the power switch.

A drawback of the circuit according to the instant invention such as previously disclosed could lie in the fact that, immediately after the closing of power switch 4, the differential amplifier 11 starts acting for decreasing the base current in this power switch and therefore for slowing down the increase speed of the current in the primary of the coil. For palliating this drawback, the instant invention provides for controlling the operation of the differential amplifier 11 through a circuit comprising a comparator 12 receiving on its first input the measured signal $V_D$ at the junction of resistors R2 and R3 (as on the first input of amplifier-comparator 9) and on its second input a second reference voltage source 13 having a value at least equal to, and preferentially slightly lower than, that of the reference source 8. Thus, the output of comparator 12 inhibits the operation of the differential amplifier 11 as long as the measured voltage, that is, the current in resistor R1, has not reached a given threshold. The negative feedback starts to be effective only when this threshold is reached.

FIG. 3 shows a detailed embodiment of some components of the circuit which is very schematically shown in FIG. 2.

The amplifier-comparator 9 comprises an amplification set constituted by transistors PNP, T57, and NPN, T59 and T62. At its input, two NPN transistors T51 and T55 are comparator-connected, the emitter of transistor T51 being connected with an input terminal E9 which receives the signal $V_D$ from the junction of resistors R2 and R3 hereinabove mentioned. The emitter of transistor T55 is connected with a resistor R8 which determines, in relation with a current source I8, the reference voltage corresponding to the voltage source 8 of FIGS. 1 and 2.

More precisely, the input comparator comprises the following connections. The transistor T51 is connected by its collector to a current source I51, the other terminal of which is connected with the supply voltage VCC. The emitter of transistor T51 is connected with terminal E9 as previously disclosed, the base of transistor T51 is connected with its collector and the base of transistor T55. The collector of transistor T55 is connected with the supply voltage VCC through a current source I8 and its emitter is grounded through a resistor R8.

The signal at the output terminal 23 of the comparator is applied to the input transistor T57 of the amplifying circuit comprising transistors T57, T59 and T62.

More precisely, the amplifying portion comprises the following connections. Transistor PNP T57, the base of which is connected with output terminal 23 of the comparator, has its emitter connected with a current source 157 which is in turn connected with the supply voltage VCC. The collector of transistor T57 is grounded through a transistor T45 maintained in the ON state. Moreover, the emitter and collector of transistor T57 are grounded through NPN transistors T56 and T60, the function of which will be detailed hereinafter. The emitter of transistor T57 is also connected with the base of the second NPN transistor T59, the collector of which is connected with terminal VCC through a current limitation resistor R59, and the emitter of which is grounded through a transistor T61, the function of which will be detailed hereinafter. The emitter of transistor T59 is also connected with the base of transistor T62, the collector of which is connected with terminal VCC through a current limitation resistor R62, and the emitter of which is grounded through a resistor R61 and is connected with the output terminal S9 of circuit 9.

The three transistors T56, T60 and T61 included in the block 30 constitute the inhibition control circuit of amplifier 9. This circuit receives a signal from the control input terminal EC9 connected with a signal processing circuit receiving information from engine 6. It will be noted that circuit 30 is also used to inhibit the differential amplifier 11.

The operation of the amplifier-comparator 9 associated with the circuit 30 is as follows:

1. When an inhibition signal is sent onto terminal EC9, transistors T56, T60 and T61 are conductive and therefore no signal is applied on the bases of the amplifying transistors T59 and T62. The output voltage of the comparator-amplifier 9 on terminal 59 is therefore at a low level and no current is applied to the resistor r10 connected with this terminal S9.

2. When a validation signal is applied to terminal EC9, transistors T56, T60 and T61 are blocked and the amplifying stage can operate.

2.1. Initially, the voltage on input terminal E9 progressively increases from a zero value. The voltage on the bases of transistors T51 and T55 also increases while remaining higher than the input voltage of the transistor base/emitter voltage. The emitter voltage of transistor T55 remains substantially equal to that of transistor T51 (E9); the collector current of transistor T55 is calculated therefrom, equal to $V_{E9}/R8$; as long as this current remains lower than that of the current source I8, transistor PNP T52 remains blocked. The current of current source I57 is therefore entirely injected into the base of transistor T59 which in turn injects an important current into the base of transistor T62 and a maximum voltage appears on the output terminal S9.

2.2. As soon as current $V_{E9}/R8$ is equal to I8, the voltage on the emitter of transistor T55 gets and remains equal to I8.R8. Then, transistor T57 becomes conductive and derives a portion of the base current of transistor T59 coming from the current source I57. The current of transistors T59 and T62 is therefore limited for reducing the voltage at output terminal S9.

The differential amplifier 11 has its input terminals connected with the terminals of resistor R10 and its output terminal A is connected with terminal A shown in the block diagram 9 at the emitter level of transistor T51, that is, at the level of terminal E9 on which the measured voltage $V_D$ is applied. This differential amplifier 11 comprises two input resistors R11 and R12 connected with the emitters of PNP transistors T63 and T70 comprising two collectors and differentially connected, that is, connected by their bases, and has a constant gain owing to an interconnection of the second collectors. The first collectors are grounded through a load constituted by two current-mirror NPN transistors T76 and T77. The collectors of transistors T76 and T77 are respectively connected with the collectors of transistors T63 and T70, their emitters being grounded, their bases being interconnected, and the collector and the base of transistor T77 being connected. The signal on the collector of transistor T76, which is the amplified image of the current in resistor R10, is applied on the output terminal A, through a diode-connected transistor T78, for ensuring a negative feedback.

As disclosed in relation with FIG. 2, it is desirable to be able to inhibit the operation of the differential amplifier 11 during the first closing phase of the main switch, that is, when the voltage $V_D$ is lower than a given threshold, which is in turn lower than the threshold determined by the reference voltage 8. The inhibition action is ensured by transistor T79, the collector of which is connected with the bases of transistors T63 and T70 through a resistor R79, the emitter of which is grounded, and the base of which is connected with a terminal B which renders this conductor conductive when it is desirable to inhibit the differential amplifier.

The control of transistor T79 is ensured by a circuit comprising, between voltage VCC and the ground, a resistor R16, a transistor T43 and a resistor R20. The base of transistor T43 is connected with the collector of transistor T45 and the emitter of transistor T43 is connected with the base of transistor T79. Thus, when the current in transistor T57 and in transistor T45 overcomes a given threshold, transistor T43 becomes conductive, which renders transistor T79 conductive. In this way, amplifier 11 starts operating very shortly before the moment when it is desirable to limit the current in the power switch 4.

The output current of the differential amplifier 11 is available on the collectors of transistors T63 and T76. The function of the diode-connected transistor T78, is to allow transistor T76 to operate with a sufficient collector voltage; indeed, terminal E9 always remains at a voltage close to the ground voltage.

The advantages of this embodiment are as follows:

the amplifier slope is easily calculable and is only slightly scattered (it only depends upon the biasing current supplied by resistor R79);

the phase shifts are reduced, since there is only one amplifying stage: the transistor T55 (the other transistors being follower-transistors which multiply the current);

the system has no other supply sources than the voltage present on the control terminal of switch 4;

the amplifier 11 is very easily set to an ON or OFF state:

if transistor T79 is conductive, resistor R79 supplies a base current to transistors T63 and T70 and the amplifier 11 operates;

if transistor T79 is blocked, amplifier 11 does not operate and has no effect.

The circuit is so designed that transistor T79 becomes conductive very shortly before the current in the coil reaches the assigned value. Thus:

the servo-control gain remains very high (amplifier 11 is off duty) during the quasi totality of the rise time of the current into the coil (period of time during which it is essential that switch 4 receives a maximum base current);

the servo-control gain decreases to a low value (amplifier 11 is on duty) shortly before the assigned value is reached, thus providing the hereinabove disclosed advantages.

It will be understood by those skilled in the art that numerous variations may be made without departing from the spirit and scope of the invention. For example, as shown in FIG. 3, it is possible to allow a current, roughly equal to I8, to flow permanently through transistor T51. This is achieved by a transistor T50 associated with transistor T46 and a current source I46. Similarly, an additional stabilization of amplifier-comparator 9 could be provided for by bringing back onto transistors T55 and T51 a portion of the output voltage of this amplifier through a time constant circuit.

I claim:

1. An ignition control circuit comprising:

a bipolar power switch (4) in series with the primary of an ignition coil (2) and a detection resistor (R1);

a voltage divider (R2, R3) in parallel with the detection resistor supplying a measured voltage proportional to the current in said detection resistor (R1);

a controlled amplifier-comparator (9), a first input of which (E9) receives the measured voltage ($V_D$), and a second input of which receives a reference voltage (8), the output of which is connected with the base of the power switch (4), and a control input of which (EC9) can receive an inhibition order signal, said amplifier-comparator acting for limiting the base current when the measured voltage approaches the reference voltage;

a series resistor (R10) between the output of said amplifier-comparator (9) and the base of the power switch (4); and a differential amplifier (11), the inputs of which are connected with the terminals of said series resistor, and the output (A) of which is connected with the first input (E9) of the amplifier-comparator (9).

2. An ignition control circuit according to claim 1, further comprising means (12; B, T79) for inhibiting the action of the differential amplifier (11) when the measured voltage is lower than a given threshold chosen, at the utmost, equal to the reference voltage.

3. An ignition control circuit according to claim 1, wherein said differential amplifier (11) comprises transistors with two collectors (T63, T70), the emitters of which are connected with the terminals of the series resistor (R10), the first collectors of which are interconnected and the second collectors of which are connected with current-mirror connected transistors (T77, T78).

4. An ignition control circuit according to claim 1, wherein resistors (R2, R3) of said voltage divider are adjustable so as to set their ratio for adjusting the current limit value of the power switch and wherein the absolute value of a resistor (R2) of said voltage divider, in series with the input of the amplifier-comparator, is chosen for determining the gain of the servo-control circuit.

5. An ignition control circuit according to claim 1, further comprising means (30) for operating or abruptly interrupting the action of the amplifier-comparator (9).

* * * * *